US006053279A

United States Patent [19]

McKenna

[11] Patent Number: 6,053,279

[45] Date of Patent: Apr. 25, 2000

[54] STRUCTURAL BEAM SAFETY ATTACHMENT

[76] Inventor: Joe McKenna, 815 Greenhedge St., Torrance, Calif. 90502

[21] Appl. No.: 09/131,069

[22] Filed: Aug. 7, 1998

[51] Int. Cl.[7] ..... A62B 35/00

[52] U.S. Cl. ..... 182/36; 182/3

[58] Field of Search ..... 248/228.5, 228.3, 248/229.14, 229.24, 231.61, 231.41, 36, 3

[56] References Cited

U.S. PATENT DOCUMENTS

| | | | |
|---|---|---|---|
| 4,606,430 | 8/1986 | Roby | 182/3 |
| 4,852,692 | 8/1989 | Flaherty | 182/231 |
| 5,011,106 | 4/1991 | Cody | 248/237 |
| 5,092,426 | 3/1992 | Rhodes | 182/3 |
| 5,526,896 | 6/1996 | O'Rourke | 182/36 |
| 5,581,955 | 12/1996 | Gleave | 52/27 |

*Primary Examiner*—Alvin Chin-Shue
*Attorney, Agent, or Firm*—Goldstein & Canino

[57] ABSTRACT

A safety attachment, for use by a worker in preventing a fall from a beam having four parallel flanges and at least one flat surface extending between two of the flanges, comprising a first main member and a second main member. Each of the main members has a U-bend which extends around one of two opposite flanges. The main members each have a joining member extending across the flat surface. A clamp comprises two parallel members and a peak. The parallel members each have an upper hole and a lower hole. One of the joining members extends through both upper holes, and the other joining member extends through both lower holes. A tether is attached between the worker and the peak of the clamp. The safety attachment slides along the beam following the worker, with the beam flanges remaining trapped within the U-bends. If the worker accidentally fell from the beam, said worker's fall would be stopped by the tether.

2 Claims, 2 Drawing Sheets

STRUCTURAL BEAM SAFETY ATTACHMENT

FIELD OF THE INVENTION

The invention relates to a structural beam safety attachment. More particularly, the invention relates to a safety device which secures to a structural beam in order to anchor a worker thereto in the event said worker slips or falls.

BACKGROUND OF THE INVENTION

Generally, workers who are maneuvering about building structures during construction periods (such as iron workers and other skilled craftsmen) must balance and walk along narrow structural beams. A simple miscalculated step or strong wind shear can cause a worker to lose his footing and fall to his death. It is typically impossible to set safety nets or scaffolds adjacent to the work area, since the rapidity with which the work proceeds would entail constant re-setting of said safety devices every few hours. In addition, it is not feasible to tether such workers to the structure due to the lack of appropriate anchoring points. Accordingly, workers employed in the construction trades often find themselves at great peril while working at high altitudes.

Various systems are found in the prior art which employ the installation of an artificial anchor point to the structure upon which the construction worker is located. These systems often entail securing the worker to said anchoring point by means of an elongated tether which would prevent the worker from plummeting to his death in the event of a mis-step. However, these systems prove bulky and awkward in that they prevent the worker from moving about the structure freely and unencumbered. In addition, these systems entail periodic installation and re-installation of the anchoring points as the work progresses. What is needed is a system which can be installed and removed quickly and easily from different locations upon an elevated structure, and allows workers to move about freely and quickly. While these prior art units may be suitable for the particular purpose employed, or for general use, they would not be as suitable for the purposes of the present invention as disclosed hereafter.

SUMMARY OF THE INVENTION

The present invention relates to a safety device which secures to a structural beam in order to anchor a worker thereto in the event said worker slips or falls.

In accordance with the invention, there is provided a structural beam safety attachment which can be installed and removed quickly and easily to and from structural steel which is employed during the construction of elevated structures. Accordingly the safety attachment clamps around the flange of a standard I-beam.

Further in accordance with the invention, there is provided a structural beam safety attachment which minimizes the number of injuries a nd deaths suffered by workers employed in the construction of elevated structures.

Further in accordance with the invention, there is provided a structural beam safety attachment which anchors a worker to a structural steel member yet allows said worker to move about freely and easily in order to perform his work tasks. Accordingly, the safety attachment is mounted for slidable movement along the beam flanges.

The invention is a safety attachment, for use by a worker in preventing a fall from a beam having four parallel flanges and at least one flat surface extending between two of the flanges, comprising a first main member and a second main member. Each o f the main members has a U-bend which extends around one of two opposite flanges. The main members each have a joining member extending across the flat surface. A clamp comprises two parallel members and a peak. The parallel members each have an upper hole and a lower hole. One of the joining members extends through both upper holes, and the other joining member extends through both lower holes. A tether is attached between the worker and the peak of the clamp. The safety attachment slides along the beam following the worker, with the beam flanges remaining trapped within the U-bends. If the worker accidentally fell from the beam, said worker's fall would be stopped by the tether.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
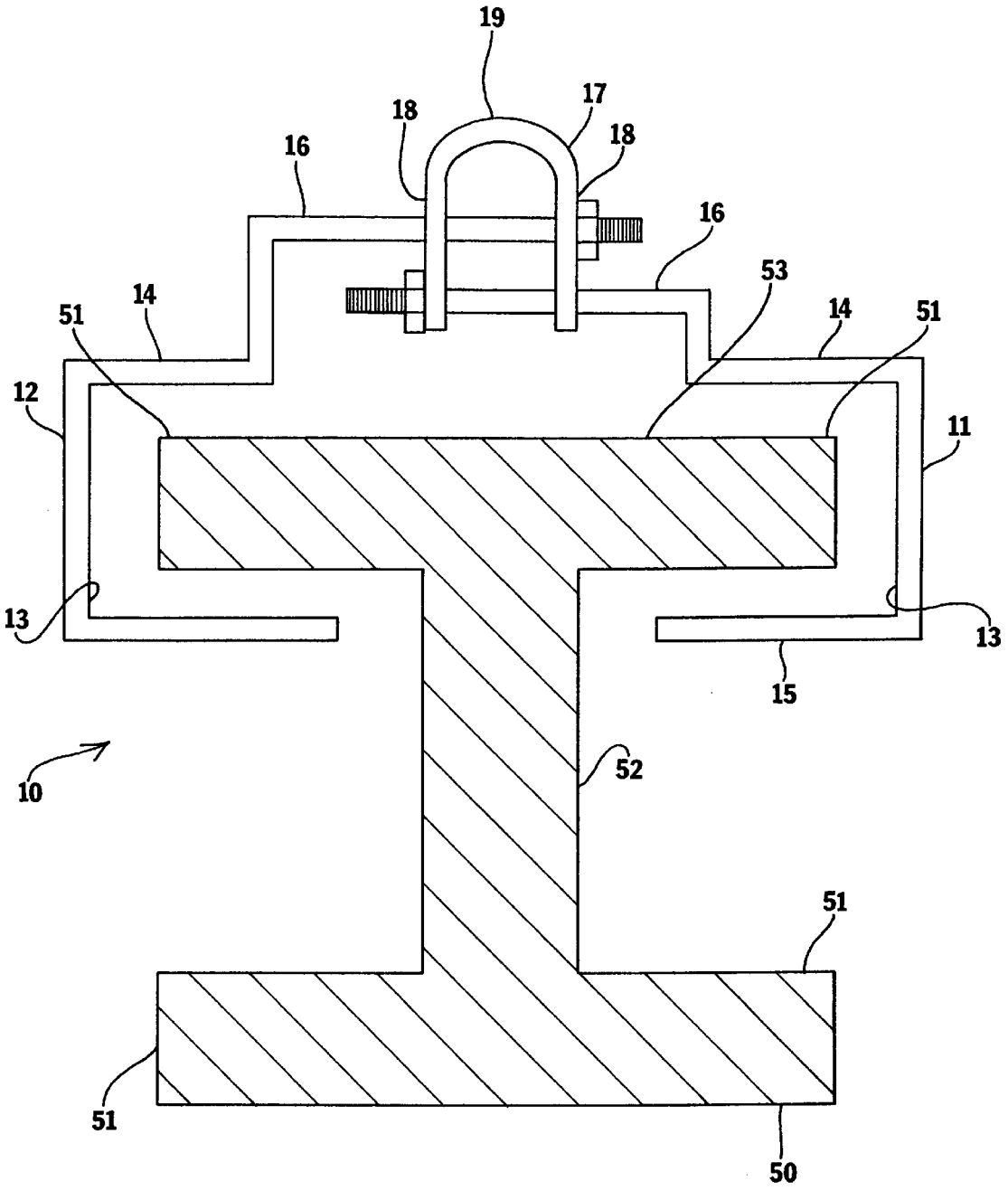
FIG. 1 is a side elevational view of the invention, per se, shown loosely connected around an I-beam, the I-beam illustrated in section.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the structural beam safety attachment. The words "proximal end" and "distal end" refer, respectively, to ends of an object nearer to and further from the operator of the object when the object is used in a normal fashion or as is described in the specification.

FIG. 1 illustrates a safety attachment 10 extending around a beam 50, shown in section. The beam 50 as illustrated is an I beam, having four parallel flanges 51, a middle beam 52 connecting all four flanges, and a flat surface 53 which is a continuous surface which forms two of the four flanges 51. The safety attachment 10 comprises a first main component 11 and a second main component 12. Each of the main components have a U-bend 13 having a top edge 14 and a bottom edge 15. The bottom edge 15 extends along one of the flanges 51 toward the middle beam 52. The top edge 14 extends across the flat surface 53.

Each of the main components 11 and 12 have a joining member 16 attached to the top edge 14 of said main component. A clamp 17 connects the joining members 16 of each of the main components. In particular, the clamp 17 comprises a pair of parallel members 18 which are separated by a peak 19. The parallel members 18 have a pair of holes 20 including an upper hole 20U and a lower holes 20L. The joining members 16 of the main components 11 and 12 each extend through both of the parallel members 18, extending through. Thus, one of the joining members 16 extends through the upper holes 19U of both parallel members 18, and the other joining member 16 extends through the lower holes 20L of both parallel members. The joining members 16 have a threaded end 30 fully opposite the U-bend. A fastening nut 31 extends onto the threaded end 30 of each main component 11 and 12 and fastens against one of the parallel members 18 to allow the U-bends 13 of each main component 11 and 12 to grip the flanges 51 therein.

Figure 2:
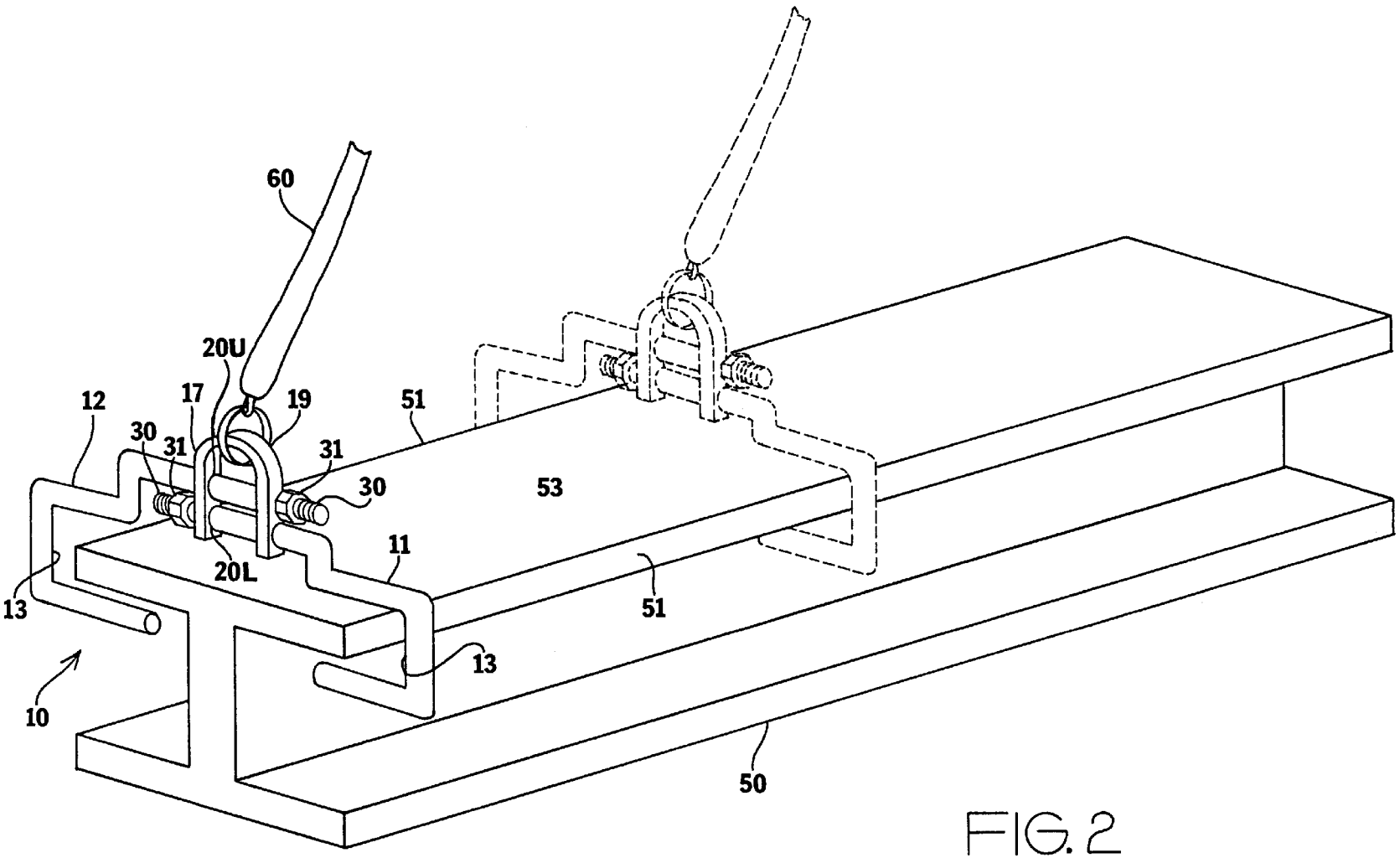
FIG. 2 is a diagrammatic perspective view, illustrating the invention in use, attached onto a beam.

FIG. 2 illustrates the safety attachment 10 in use. The main components 11 and 12 span across the flat surface 53 of the beam, and the U-bends 13 thereof grip around the flanges 51. A tether 60 is clipped around the peak 19 of the clamp 17. The tether 60 is attached to a worker, and has a tether length which is selected to allow the worker adequate freedom to perform tasks, but to ensure that the worker cannot fall any significant distance before the fall is stopped by the safety attachment 10. As the worker moves along the beam 50, the safety attachment 10 is pulled along the beam, following the worker as illustrated in phantom.

If the worker accidentally fell from the beam 50, the safety attachment 10 would prevent the worker from falling more than the length of the tether 60. Since the U-bends 13 remain in close proximity to the beam, the beam flanges 51 would be trapped within the U-bends, preventing the safety attachment 10 from pulling free of the beam 50, and thus stopping the worker's fall.

It is also important to note the flat surface 53 chosen in the drawing figures is a top surface of the beam. Thus, the safety attachment 10 as shown would remain at the worker's feet while the worker continued to move along the beam. However, the flat surface 53 employed may also be a bottom surface of the beam. Thus, the safety attachment 10 can be attached around the bottom surface of an overhead beam. The tether 60 would then extend upward from the worker to the overhead beam. In this way, a fall from the beam would be quickly stopped, and further injury prevented.

In conclusion, herein is presented a beam safety attachment which attaches around a pair of flanges on a beam and is tethered to a worker therefrom. The beam safety attachment follows the worker as said worker moves along the beam, and stops the worker from falling if said worker accidentally falls from the beam.

What is claimed is:

1. A structural beam safety attachment, for use by a worker in preventing a fall from a beam having a pair of opposite flanges and a flat surface extending between the flanges, comprising:

a first main component and a second main component, each of said main components having a U-bend each for extending around one of the beam flanges when the first main component and second main component extend across the flat surface and for allowing slidable movement along the beam when anchoring to said beam, each of said main components having a joining member;

a clamp, attaching the joining members of the first main component and second main component, comprising a pair of parallel members and a peak, a tether attached at the peak, the parallel members each having an upper hole and a lower hole, one of the joining members extends through both upper holes, and the other joining member extends through both lower holes; and the tether, attachable to the clamp at one end and attached to the worker at an opposite end therefrom, the tether for indirectly securing the worker to the beam and preventing said worker from falling from the beam.

2. The safety attachment as recited in claim 1, wherein each of the joining members has a threaded end fully opposite from the U-bend, and further comprising a pair of fastening nuts, each fastening nut attaches onto the threaded end of one of the joining members and tightens against one of the parallel members of the clamp.

* * * * *